United States Patent [19]

Hilfiker

[11] 4,343,572

[45] Aug. 10, 1982

[54] APPARATUS AND METHOD FOR ANCHORING THE RIGID FACE OF A RETAINING STRUCTURE FOR AN EARTHEN FORMATION

[75] Inventor: William K. Hilfiker, Eureka, Calif.

[73] Assignee: Hilfiker Pipe Co., Eureka, Calif.

[21] Appl. No.: 129,602

[22] Filed: Mar. 12, 1980

[51] Int. Cl.[3] ..... E02D 29/02

[52] U.S. Cl. ..... 405/284; 405/287

[58] Field of Search ..... 405/15, 258, 262, 272, 405/284–287

[56] References Cited

U.S. PATENT DOCUMENTS

| | | | |
|---|---|---|---|
| 1,762,343 | 6/1930 | Munster | 405/262 |
| 3,421,326 | 1/1969 | Vidal | 405/284 |
| 3,686,873 | 8/1972 | Vidal | 405/262 |
| 4,045,965 | 9/1977 | Vidal | 405/287 |
| 4,117,686 | 11/1977 | Hilfiker | 405/284 |

FOREIGN PATENT DOCUMENTS

| | | | |
|---|---|---|---|
| 2233857 | 1/1975 | France | 405/262 |
| 2303121 | 10/1976 | France . | |

*Primary Examiner*—David H. Corbin

*Attorney, Agent, or Firm*—Naylor, Neal & Uilkema

[57] ABSTRACT

A rigid face member is held in place at the face of an earthen formation by anchor elements embedded within the formation. Deformable sections are incorporated into the anchor elements adjacent the face member to permit the anchor elements to move with the formation in the event of earthquake or settling, while maintaining the face member in place.

5 Claims, 4 Drawing Figures

APPARATUS AND METHOD FOR ANCHORING THE RIGID FACE OF A RETAINING STRUCTURE FOR AN EARTHEN FORMATION

BACKGROUND OF THE INVENTION

The present invention relates to a retaining structure for earthen formations and, more particularly, is concerned with a method and apparatus for providing such a structure which serves to anchor face elements to the formation and accommodate relative movement between these elements and anchoring or reinforcement elements embedded within the formation. In its more specific aspects, the invention is concerned with such a method and apparatus for securing rigid face elements in place upon a foundation in such a way that movement of the formation as the result of earthquake or settling does not impart destructive forces to the face elements or the anchoring means therefor.

The problem of accommodating relative movement between rigid face elements for a retaining wall structure and the anchor means for the elements was dealt with in U.S. Pat. No. 1,762,343 to Munster. In the structure of that patent, vertically extending ribs were formed on the face elements and the anchor members were slidably connected to these ribs for movement relative thereto to accommodate settling of the earthen formation. The structure required that special ribs be formed on the face elements and depended upon maintaining a slidable connection between these ribs and the anchoring elements. Once the structure of the patent was in place and fully loaded, it is doubtful that such a slidable connection could be maintained.

Other prior art efforts have accommodated for relative movement between the face members of a retaining structure and anchoring means therefor by fabricating the face members as flexible cladding which is relatively free to move in the event that the earthen formation settles. Such teachings are found, for example, in U.S. Pat. Nos. 3,421,326 and 3,686,873 to Vidal. Still other efforts to accommodate settling in earthen formation retaining structures have relied on the employment of retaining structures which are comprised entirely of flexible wire grid elements. Such efforts are found in the relatively ancient gabions, as well as some relatively recent efforts which employ wire grid works which serve to provide both earth reinforcement and a face for the earthen formation being reinforced. Examples of the latter recent efforts may be found in my prior U.S. Pat. No. 4,117,686 and in French Pat. No. 7,507,114 to Vidal.

The present invention is designed primarily for use with earthen retaining structures wherein foundation supported relatively rigid face members are employed. To that extent, of the above discussed patents, U.S. Pat. No. 1,762,343 is thought to be the most significant.

RELATED APPLICATIONS

U.S. applications Ser. No. 56,826, filed July 12, 1979, and Ser. No. 110,763, filed Jan. 9, 1980, jointly filed by me, Harold O. Hilfiker and William B. Hilfiker are related to the present application to the extent that they show earthen retaining structures of the type with which the present invention might be used.

SUMMARY OF THE INVENTION

In the method and apparatus of the present invention, a foundation supported rigid face member is located at the face of earthen formation and held in place by anchors or reinforcing elements embedded within the formation. Deformable connecting elements accommodate relative movement between the face member and the embedded anchors or reinforcing elements. In the preferred embodiments, deformable elements take the form of wire zigzag sections which may deform to accommodate such movement in the event of earthquake or settling of the formation.

A principal object of the present invention is to provide an improved connection for securing a retaining face for an earthen formation in place in such a way that the face and the anchoring elements therefor will not be subjected to destructive loading in the event of earthquake or settling of the formation.

Another object of the invention is to provide such a connection of simplified construction which is not dependent upon slidably interconnected elements.

Yet another object of the invention is to provide such a connection which may be readily incorporated into reinforcing systems for earthen formations, with a minimum amount of modification to the systems.

Still another object related to the latter object is to provide such a connection which may be incorporated into known reinforcing systems and does not complicate the application of the systems or add materially to the expense thereof.

The foregoing and other objects will become more apparent when viewed in light of the accompanying drawings and following description.

DESCRIPTION OF THE FIRST EMBODIMENT

Figure 1:
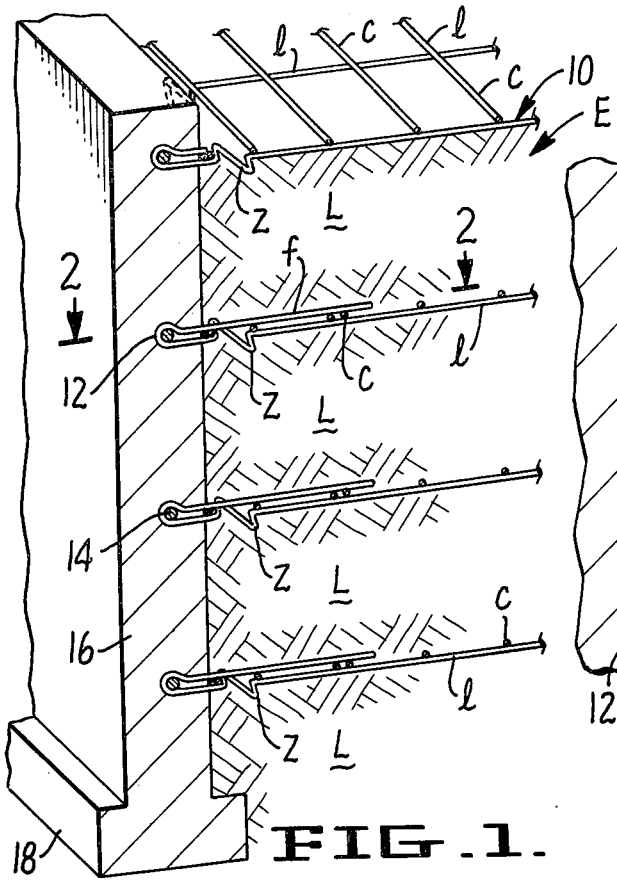
FIG. 1 is a perspective view, with parts thereof broken away and shown in section, illustrating an earthen formation retained by a system incorporating a first embodiment of the invention.
Figure 2:
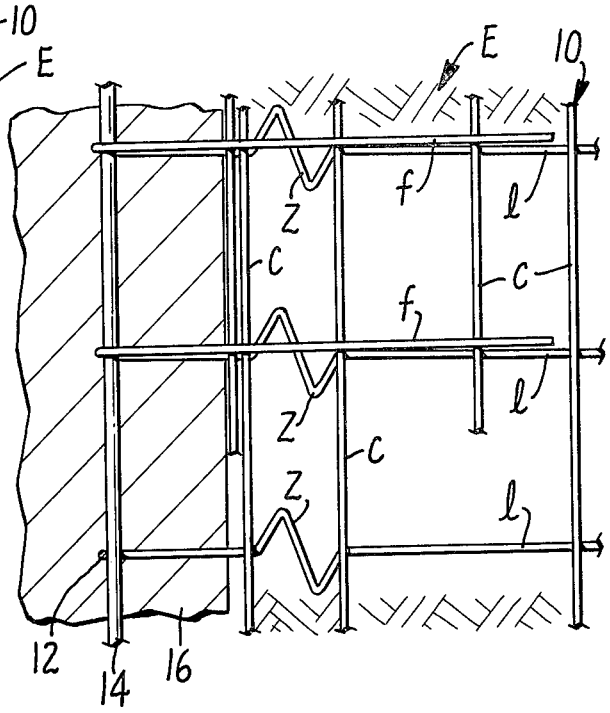
FIG. 2 is a cross-sectional view taken on the plane designated by line 2—2 of FIG. 1.

Referring now to FIG. 1, the earthen formation to be reinforced is designated by the letter "E" and is shown as being divided into horizontal layers "L". The layers "L" typically have a height of one to two feet and have interposed therebetween anchoring/reinforcing mats 10. The mats 10 comprise welded wire grid works having longitudinally extending tension rods "l" with cross rods "c" welded thereto and extending thereacross. Typically, the cross rods "c" are spaced from one another by six to 12 inches and the longitudinally extending rods "l" are spaced from one another by from two to six inches and welded to the rods "c" at the intersections therewith.

Although the wire from which the mats are fabricated may vary, nine gauge welded wire material has been found ideal for most applications. The mat length (i.e. depth to which it extends into the formation to be reinforced) may also vary, depending upon the nature of the formation and the height of the wall. As a general rule of thumb for most situations, this length should be approximately 80% of the height of the formation.

In the first embodiment, the mats 10 are folded over at the distal ends 12 so as to provide a folded-over section "f" superimposed over the main body of the mat. Preferably, the folded-over sections "f" are preformed prior to placement of the mats in an earthen formation.

The distal ends 12 of the mats 10 carry transversely extending rods 14 and these rods are cast in place within a concrete face member 16. As shown, the face member 16 is formed in place at the face of the earthen formation to be reinforced and the lower end of the face member is supported on a foundation 18.

In assembling the reinforcing wall of the first embodiment, the face of the formation is first excavated and then the mats 10 are layed in place, with the back-fill layers "L" filled in as each successive mat is positioned. After all the mats are positioned, suitable forming is set up and the face 16 and foundation 18 therefor is formed and poured. Once the face and foundation are set, the forms are removed therefrom.

The mats 10 serve to both reinforce the back-filled earthen formation and to secure the face member 16 against displacement. To permit movement of the face member relative to the earthen formation in the event of settling of the formation, earthquake, deformable zigzag sections "Z" are formed in the tension rods "l" closely adjacent the rear side of the face member 16. The sections "Z" are formed in the elongate lower body of the mats, with the folder-over sections "f" thereover. In the preferred embodiment, the folded-over section "f" is provided with a cross rod "c" at the distal end thereof which serves to anchor the face member against separation from the earthen formation. This cross rod is preferably located at a depth within the earthen formation greater than the depth at which the Z-section is located.

As shown, the components of the zigzag sections "Z" extend at an angle of about 60° relative to the tension rods "l" and are integrally formed with rods during the manufacture of the mats 10. In the event of overloading of the rods "l", the zigzag sections elongate to permit relative movement between the face member 16 and the earthen formation, without imparting destructive forces to the face member or the mats. The extent of the zigzag sections is chosen so that such elongation fully accommodates any relative movement between the face member and the earthen formation, without dragging the mats through the earthen formation, or imparting destructive forces to the mats or the face member. It should be appreciated that during elongation of the zigzag sections "Z", the sections continue to transmit anchoring forces to the face member. Additionally, during such elongation, the folded-over sections "f" continue to perform an anchoring function for the face member.

DESCRIPTION OF THE SECOND EMBODIMENT

Figure 3:
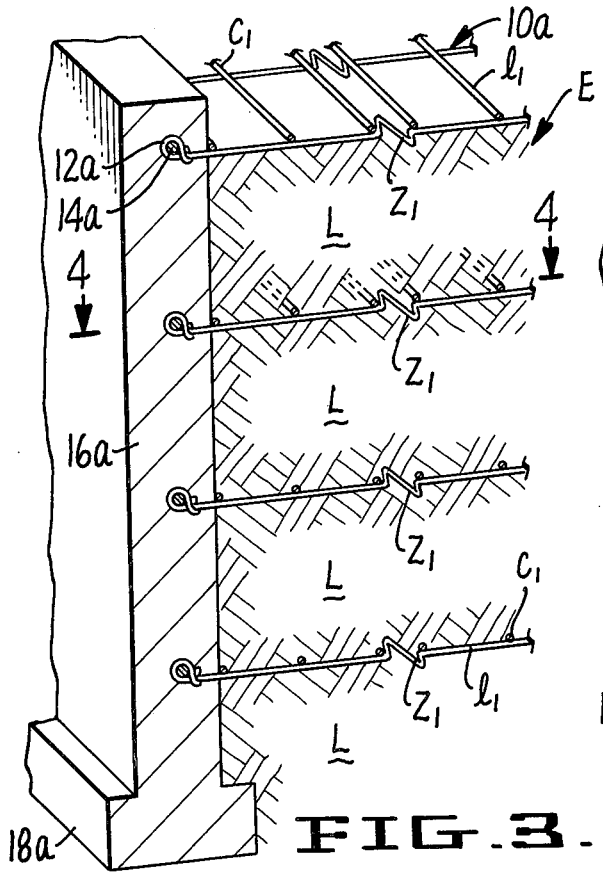
FIG. 3 is a perspective view, with parts thereof broken away and shown in section, illustrating an earthen formation retained by a system incorporating a second embodiment of the invention.
Figure 4:
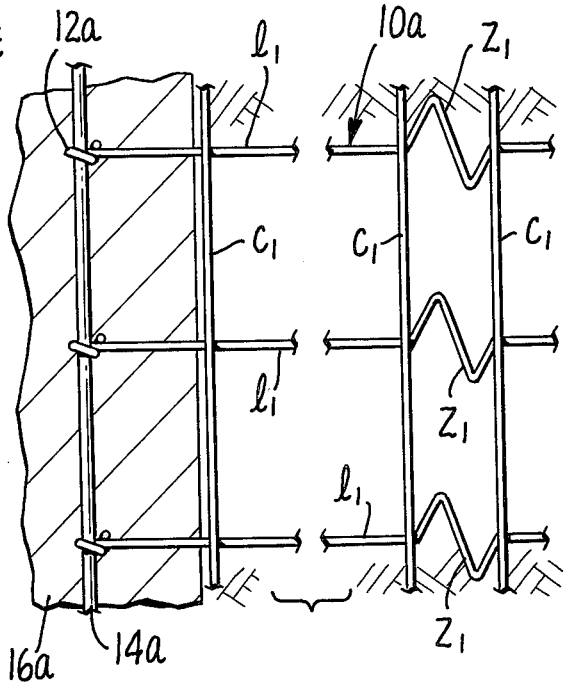
FIG. 4 is a cross-sectional view taken on the plane designated by line 4—4 of FIG. 3.

This embodiment, as shown in FIGS. 3 and 4, differs from the first embodiment, primarily in that the zigzag sections are spaced from the face member by a greater distance and the distal ends of the mats are not formed with folded-over sections. The earthen formation shown in FIG. 3 is designated by the letter "E" and is divided into layers "L" similarly to the earthen formation shown in FIG. 1. The basic elements of the second embodiment retaining wall correspond generally to those of the first embodiment wall and are designated by like numberals, followed by the subscript "a", as follows: mats 10*a;* distal ends 12*a;* rods 14*a,* face member 16*a;* and foundation 18*a.*

The mats 10*a* may be fabricated of welded wire corresponding to that used for the mats 10. As illustrated, the tension rods of the mats 10*a* are designated "$l_1$" and the cross rods "$c_1$". Distal ends 12*a* are looped around the rods 14*a* and secured by a simple twist, as may be seen in FIG. 3. The zigzag sections of the mats 10*a* are designated "$Z_1$" and are spaced from the distal ends 12*a* by a distance necessary to anchor the facing (e.g., double the distance between two of the cross rods "$c_1$"). Thus, as may be seen from FIGS. 3 and 4, two cross rods "$c_1$" are interposed between the zigzag sections "$Z_1$" and the face member 16*a.* These two rods serve to assist in securing the face member against the earthen formation in the event of the relative movement therebetween and resulting elongation of the zigzag section "$Z_1$". Thus, these first two cross rods serve a function similar to the cross rod at the distal end of the folded-over section "f" in the first embodiment.

The second embodiment wall is erected in a manner identical to that described with respect to the first embodiment wall. The resulting wall is comprised of back-fill earth reinforced by the mats 10*a.* The mats serve to both reinforce the formation and secure the face member 16*a* in place. Zigzag sections "$Z_1$" accommodate relative movement between the face member and the earthen formation in a manner similar to that described with reference to the zigzag sections "Z" of the first embodiment.

CONCLUSION

From the foregoing description, it should be apparent that the present invention enables the attainment of the objects initially set forth herein. It should be understood, however, that the invention is not intended to be limited to the specifics of the illustrated embodiments. For example, it is ancticipated that the zigzag sections may vary in configuration to provide a greater or lesser degree of relative movement between the face members and the earthen formation. It is also anticipated that the anchoring elements within which the zigzag sections are incorporated may take a form other than welded wire reinforcing mats. For example, these elements might comprise tension rods for rock anchors or embedded deadman anchors.

What is claimed is:

1. In a retaining structure for an earthen formation wherein longitudinally extending anchoring elements are embedded in the formation and a substantially rigid face member is supported on a foundation at the face of the formation and secured to the anchoring elements; the improvement comprising deformable zigzag sections in the longitudinally extending elements, said sections being located only adjacent the face member and being elongatable with destruction thereof to permit relative movement between the face member and portions of said elements spaced from the face member in response to relative movement between the formation and the face member, while maintaining a secured connection between the elements and face member to maintain the face member in place at the face of the earthen formation, said portions spaced from the face member comprising the majority of the anchoring elements and being so placed as not to move in the absence of movement of the formation within which they are embedded.

2. In a retaining structure according to claim 1, wherein the anchoring elements are incorporated in welded wire grid works embedded in the formation.

3. In a retaining structure according to claim 2, wherein the grid works include a multiplicity of cross elements welded to an extending transversely of the longitudinal elements in spaced relationship to one another; the improvement wherein the zigzag sections are positioned at a location between the face member and at least the majority of said cross elements.

4. In a retaining structure according to claim 3, the improvement wherein: the zigzag sections are positioned so that at least certain of the cross elements are embedded in the formation and connected directly to the face member by the longitudinal elements; and the zigzag elements are located between said certain cross elements and other cross elements.

5. In a retaining structure for an earthen formation wherein anchoring elements comprising welded wire grid words are embedded in the formation to effect the reinforcement thereof and a substantially rigid face member is supported on a foundation at the face of the formation and secured to the anchoring elements at fold lines between folded-over relatively long and short superimposed sections of the grid works; the improvement comprising zigzag sections incorporated into the relatively long sections of the grid works at locations closely adjacent the face member, said zigzag sections being deformable to permit relative movement between at least a portion of the elements and the face member, while maintaining a secure connection therebetween to maintain the face member in place at the face of the earthen formation.

* * * * *